US005759145A

United States Patent [19]

Kagawa

[11] Patent Number: 5,759,145

[45] Date of Patent: Jun. 2, 1998

[54] TEARABILITY IMPARTING APPARATUS

[76] Inventor: Seiji Kagawa, 77-1-1409, Sezaki-cho, Soka-shi, Saitama-ken, Japan

[21] Appl. No.: 589,514

[22] Filed: Jan. 22, 1996

[30] Foreign Application Priority Data

Feb. 2, 1995 [JP] Japan ..... 7-015839

[51] Int. Cl.[6] ..... B65B 61/00; B65B 9/02

[52] U.S. Cl. ..... 493/212; 493/228; 493/355; 493/363; 493/364; 493/930; 53/133.6; 53/133.8

[58] Field of Search ..... 53/133.5, 133.6, 53/133.8; 83/660, 866, 875, 663; 493/364, 363, 355, 372, 242, 212, 930, 963, 228

[56] References Cited

U.S. PATENT DOCUMENTS

| | | | |
|---|---|---|---|
| 2,923,052 | 2/1960 | Marogg | 493/363 |
| 3,359,773 | 12/1967 | Stuchbery | 493/355 |
| 4,176,567 | 12/1979 | Weisberg | 83/660 |
| 4,386,925 | 6/1983 | Focke | 493/242 |
| 5,257,923 | 11/1993 | Kagawa | 83/663 |
| 5,430,987 | 7/1995 | Lane, Jr. et al. | 493/363 |

FOREIGN PATENT DOCUMENTS

| | | |
|---|---|---|
| 0 459 754 | 12/1991 | European Pat. Off. . |
| 0 516 094 | 12/1992 | European Pat. Off. . |
| WO 88/05013 | 7/1988 | WIPO . |

*Primary Examiner*—James F. Coan
*Assistant Examiner*—Gene L. Kim
*Attorney, Agent, or Firm*—Kenyon & Kenyon

[57] ABSTRACT

An apparatus for imparting a tearable region to a pre-formed pouch. A lower block has a flat surface on which is provided a lower perforating member that corresponds to a corner of the unsealed pouch. The lower perforating member has been formed by depositing a large number of particles having acute corners and a Mohs hardness of not less than 5 on the lower block flat surface. An upper block with an upper perforating member that corresponds to the corner of the pouch is arranged above the lower block. The upper perforating member has been formed by depositing a large number of particles having acute corners and a Mohs hardness of not less than 5 on the upper block flat surface. The upper perforating member opposes the lower perforating member. The upper block is moved towards the lower block, pressing the acute corners of the particles into opposing surfaces of the preform, sealing the pouch with a tearable area.

11 Claims, 6 Drawing Sheets

TEARABILITY IMPARTING APPARATUS

BACKGROUND OF THE INVENTION

1. Field of the Invention

The present invention relates to an apparatus for imparting tearability to an unsealed pouch.

2. Description of the Related Art

Recently, various liquid products such as liquid soup, liquid detergents, and liquid curry are contained in sealed pouches formed by using an organic resin film as a base film and put on the market. Gusset sealed pouches are self-supporting and therefore suited to contain, e.g., liquid soup and liquid detergents. An unsealed pouch of this type is manufactured by preparing a layflat and tubular member made from a laminated film consisting of a heat-fusible resin film such as a polyethylene film and a rigid organic resin film such as a nylon film. The leading and trailing ends of this tubular member are open, and the heat-fusible resin film is located inside. The heat-fusible resin film of this tubular member is heat-sealed, and the resultant tubular member is cut into desired dimensions. A sealed pouch obtained from the unsealed pouch has a structure illustrated in FIG. 12. That is, a sealed pouch 1 has a heat seal 2 formed in the peripheral edges of the pouch, a gusset 3 formed in the bottom, and an elongated discharge portion 4 formed in one upper corner and having a closed end. A liquid injection portion is open in a portion of the side near the discharge portion 4 and heat-sealed after a liquid 5 is injected.

In the manufacture of the sealed pouch as described above, a heat-fusible resin film such as a polyethylene film having good heat-sealing properties is always used as a base film in order to form the shape of a tube. Unfortunately, this heat-fusible resin film has the property of being not easy to tear in both longitudinal and transverse directions, particularly obliquely. For this reason, it is impossible to open the sealed pouch 1, FIG. 12, by obliquely tearing it by fingers across the closed, long and narrow discharge portion 4. In particular, it is almost impossible to tear gusset sealed pouches by fingers because a nylon film as the material of a packaging film is thick. To open the gusset sealed pouch 1, therefore, it is necessary to cut the pouch 1 across the elongated discharge portion 4 by using scissors 6 as shown in FIG. 12. That is, opening sealed pouches of this sort is very troublesome.

SUMMARY OF THE INVENTION

It is an object of the present invention to provide a tearability imparting apparatus capable of imparting tearability to the corner of an unsealed pouch at which a closed liquid discharge portion is located, thereby making the corner easily tearable obliquely.

The present invention provide an apparatus for imparting to a pre-form which has been prepared by heat-sealing a layflat and tubular member opening at both ends and having a heat-fusible film on inner surface, and which has a plurality of unsealed pouches, each having a opening in one side, more precisely, imparting tearability to the corner of each unsealed pouch, in which the closed liquid discharge portion is located, the apparatus comprising:

a lower block having a first perforating member on a surface region, the first perforating member being formed by depositing a large number of particles having acute corners and a Mohs hardness of 5 or more on the surface region;

an upper block arranged above the lower block and having a second perforating member on a surface region opposing the first perforating member, the second perforating member being formed by depositing a large number of particles having acute corners and a Mohs hardness of 5 or more on the surface region; and driving means for moving the upper block toward the lower block until a distance between points of the particles on the first and second perforating members becomes smaller than a thickness of the pre-form supplied onto the lower block, thereby pressing the acute corners of the large number of particles into both surfaces of the corner of each unsealed pouch formed in the pre-form, forming a large number of non-through pores.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Figure 1:
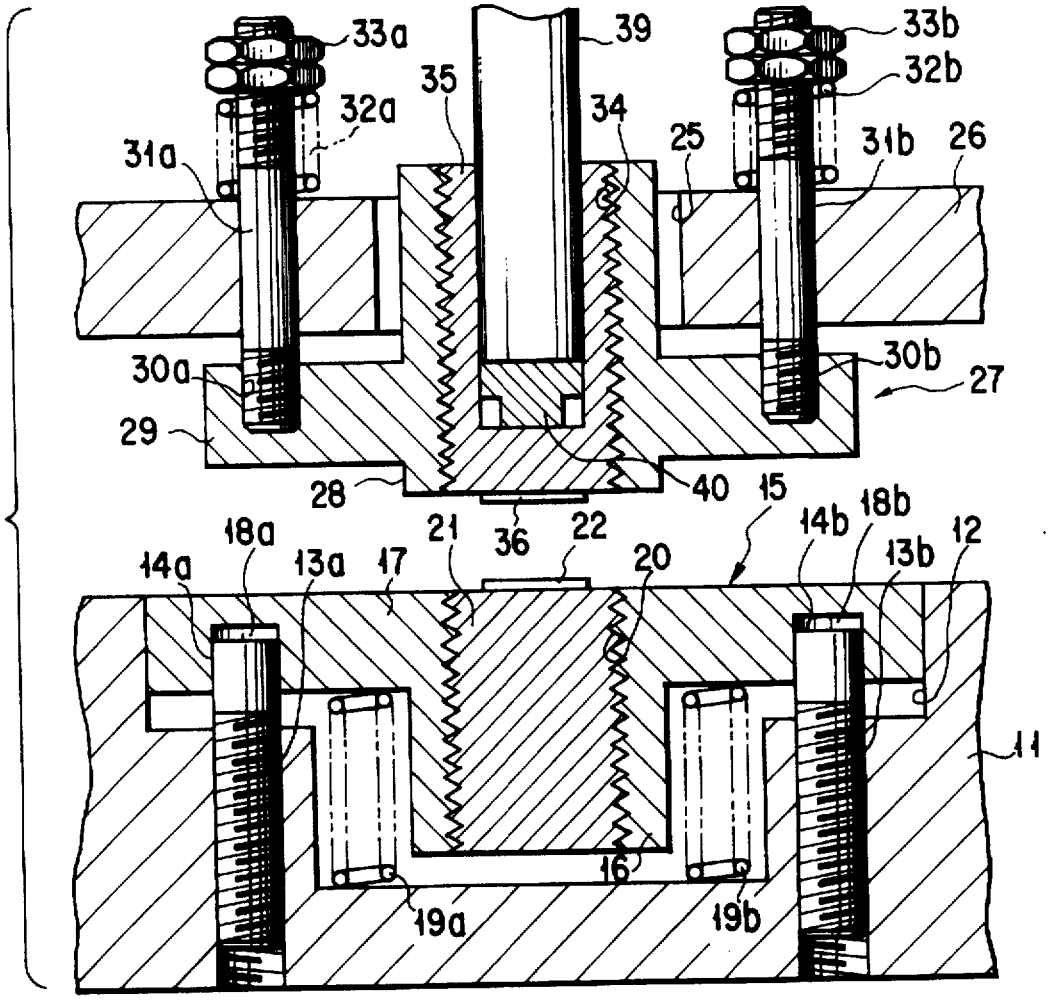
FIG. 1 is a sectional view showing a tearability imparting apparatus according to an embodiment of the present invention.

A tearability imparting apparatus according to the present invention is an apparatus for imparting to a pre-form which has been prepared by heat-sealing a layflat and tubular member opening at both ends and having a heat-fusible film on inner surface, and which has a plurality of unsealed pouches, each having a opening in one side, more precisely, imparting tearability to the corner of each unsealed pouch, in which the closed liquid discharge portion is located, the apparatus comprising:

a lower block having a first perforating member on a surface region, the first perforating member being formed by depositing a large number of particles having acute corners and a Mohs hardness of 5 or more on the surface region;

an upper block arranged above the lower block and having a second perforating member on a surface region opposing the first perforating member, the second perforating member being formed by depositing a large number of particles having acute corners and a Mohs hardness of 5 or more on the surface region; and driving means for moving the upper block toward the lower block until a distance between points of the particles on the first and second perforating members becomes smaller than a thickness of the pre-form supplied onto the lower block, thereby pressing the acute corners of the large number of particles into both surfaces of the corner of each unsealed pouch formed in the pre-form, forming a large number of non-through pores.

Examples of the tubular member are a made solely from a heat-fusible resin film and a laminated film consisting of a heat-fusible resin film and a rigid organic resin film in has open leading and trailing ends, and in which the heat-fusible resin film is arranged on the inner surfaces of the member. Examples of the heat-fusible resin are polyethylene such as low-density polyethylene and linear, low-density polyethylene, an ethylvinylacetate copolymer (EVA), and unstretched polypropylene. Examples of the rigid organic resin are polyethyleneterephthalate (PET), nylon, and orientated polypropylene.

The first and second perforating members on the two blocks are formed by depositing a large number of particles having acute corners and a Mohs hardness of 5 or more on predetermined surface regions of the respective blocks by, e.g., electro-deposition or a bonding method using an organic or inorganic binder. It is desirable that the first and second perforating members have the shape of an isosceles triangle. It is desirable that the large number of particles be deposited on 70% or more of the predetermined surface region of each block.

A plurality of first perforating members and a plurality of second perforating members can also be formed on the respective blocks.

Examples of the particle with a Mohs hardness of 5 or more are a hard metal particle such as a tungsten carbide particle; a silicon carbide particle, a boron carbide particle, a sapphire particle, and a cubic boron nitride (CBN) particle; and natural and synthetic diamond particles. In particular, a natural or synthetic diamond particle with a high hardness and a high strength is desirable. It is preferable to use natural or synthetic diamond particles with a particle size of 10 to 100 fm and a particle size variation of 5% or less. When diamond particles are to be used as the large number of particles with a Mohs hardness of 5 or more, these diamond particles are preferably deposited by electro-deposition on a predetermined surface region of each block made of a metal such as steel and stainless steel. In this electro-deposition, it is desirable that an Ni layer or a Cr layer be previously formed on the electro-deposition surface of each block by using a plating technology.

The present invention described above is an apparatus for imparting to a pre-form which has been prepared by heat-sealing a layflat and tubular member opening at both ends and having a heat-fusible film on inner surface, and which has a plurality of unsealed pouches, each having a opening in one side, more precisely, imparting tearability to the corner of each unsealed pouch, in which the closed liquid discharge portion is located. The apparatus makes use of a lower block having a first perforating member on a surface region, the first perforating member being formed by depositing a large number of particles having acute corners and a Mohs hardness of 5 or more on the surface region, and an upper block arranged above the lower block and having a second perforating member on a surface region opposing the first perforating member, the second perforating member being formed by depositing a large number of particles having acute corners and a Mohs hardness of 5 or more on the surface region. A driving means of the apparatus moves the upper block toward the lower block until the distance between points of the particles on the first and second perforating members becomes smaller than the thickness of the pre-form supplied onto the lower block, and presses the acute corners of the large number of particles into both surfaces of the corner of each unsealed pouch formed in the pre-form. Consequently, a large number of fine non-through pores can be formed in both the surfaces of the corner of the unsealed pouch.

The pre-form processed by the tearability imparting apparatus of the present invention is cut to separate the unsealed pouches, a desired liquid is contained through an opening (liquid injection portion) of each unsealed pouch, and the injection portion is heat-sealed to obtain a sealed pouch. A large number of fine non-through pores are formed in both the surfaces of the corner of this sealed pouch at which the closed discharge portion is located. That is, the sealed pouch has a non-through pore formation region with a large number of non-through pores in the corner at which the liquid discharge portion is located. When this sealed pouch is held by fingers of one hand and the non-through pore formation region is pulled by fingers of the other hand, the large number of non-through pores successively act as the starting points of tear on both the sides of the boundary between the non-through pore formation region and a region in which no non-through pores are formed. Consequently, the corner at which the liquid discharge portion is located is readily torn apart in the boundary and separated. Accordingly, in opening the sealed pouch to discharge the internal liquid through the liquid discharge portion, the liquid discharge portion can be opened by tearing apart the corner without using scissors unlike in the case of conventional sealed pouches. This greatly simplifies the act of opening.

A preferred embodiment of the present invention will be described below.

Figure 2:
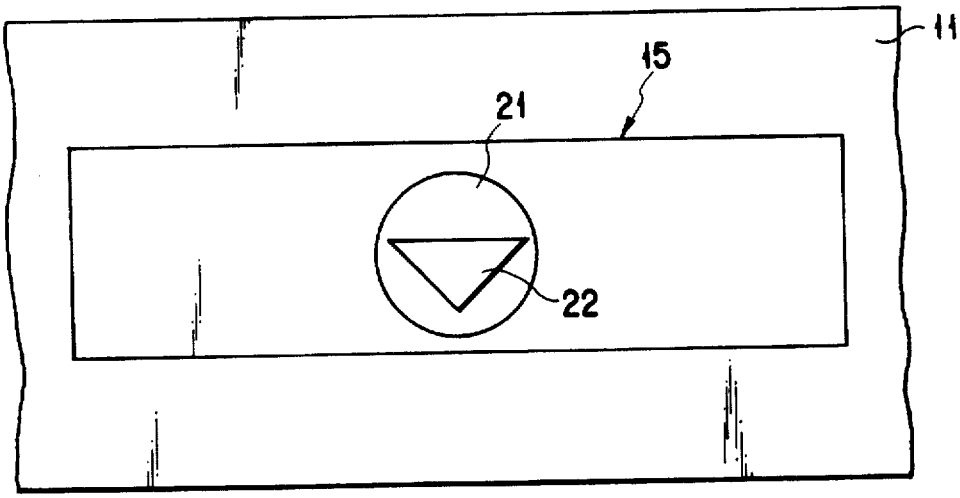
FIG. 2 is a plan view showing a table which constitutes the apparatus in FIG. 1.
Figure 3:
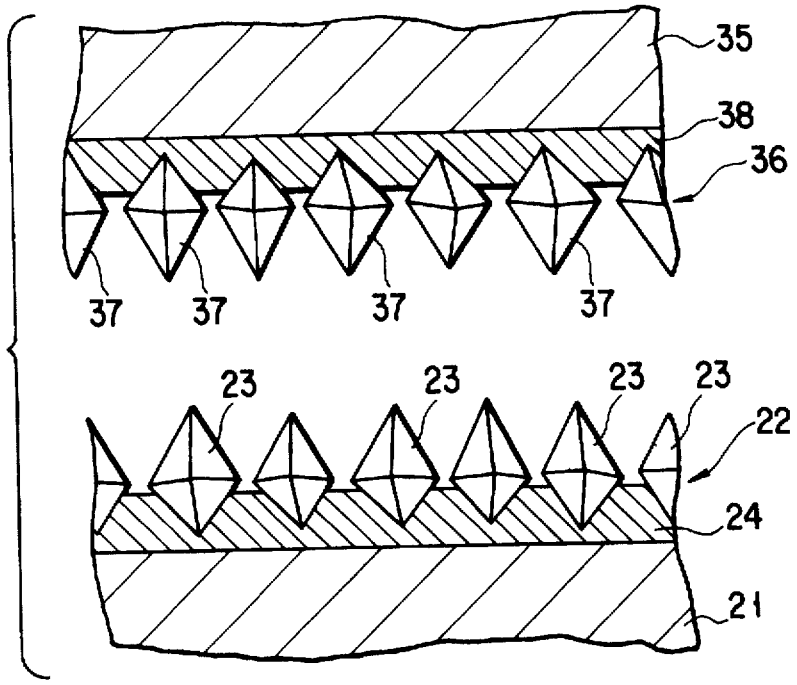
FIG. 3 is an enlarged sectional view showing the main components of the apparatus in FIG. 1.

FIG. 1 is a sectional view showing a tearability imparting apparatus according to the embodiment of the present invention. FIG. 2 is a plan view showing a table constituting the apparatus in FIG. 1. FIG. 3 is an enlarged sectional view of the major parts of the apparatus in FIG. 1. A staircase depression 12 which is depressed toward the central portion is formed in a table 11 made of, e.g., stainless steel. Screw holes **13*a* and 13*b* are formed from the bottom surface of the table 11 to the surfaces of the left and right stairs in the depression 12. Threaded columns 14*a* and 14*b* are screwed into the screw holes 13*a* and 13*b*, respectively, so that their respective upper end portions protrude from these holes. A lower frame 15 formed by combining a rectangular plate 17 and a square pillar 16, both of which are made of stainless steel, and having a T sectional shape is arranged in the depression 12. Columnar holes 18***a* and 18*b* are formed in the vicinities of the two end portions of the plate 17 constituting the lower frame 15. These columnar holes 18*a* and 18*b* are formed from the lower surface side of the plate 17 and engage with the protruding upper end portions of the columns 14*a* and 14*b*, respectively. Springs 19*a* and 19*b* are interposed between the bottom surface of the depression 12 and the lower surface of the plate 17 and bias the lower frame 15 upward. The square pillar 16 has a vertical, columnar threaded through hole 20. A columnar lower block 21 having a threaded outer circumferential surface is screwed into the columnar through hole 20 of the square pillar 16. As shown in FIG. 2, a first perforating member 22 having the shape of a rectangular equilateral triangle is formed on the surface of the lower block 21. As shown in FIG. 3, the first perforating member 22 is formed by depositing a large number of particles, e.g., synthetic diamond particles 23, having acute corners and a Mohs hardness of 5 or more on the surface of the lower block 21 via an electro-deposition layer 24.

An elongated movable plate 26 made of, e.g., stainless steel and having an opening 25 in the center is arranged above the table 11. An upper frame 27 formed by combining a rectangular plate 29 and a square pillar 28, both of which are made of stainless steel, and having an inverted T sectional shape is arranged above the lower frame 15. The movable plate 26 is vertically moved by a first hydraulic mechanism (not shown) constituting a driving means. Screw holes 30*a* and 30*b* are formed in the vicinities of the two end portions of the plate 29 constituting the upper frame 27. Columns 31*a* and 31*b* having threaded upper and lower ends are screwed into the screw holes 30*a* and 30*b*, respectively, of the plate 29 through the portions of the movable plate 26 on the left and right sides of the opening 25. Coil springs 32*a* and 32*b* are so arranged as to surround the upper end portions of the columns 31*a* and 31*b*, respectively, protruding from the upper surface of the movable plate 26. Double nuts 33*a* and 33*b* are threadably engaged with the threaded portions in the upper ends of the columns 31*a* and 31*b*, respectively. The upper frame 27 is suspended from the movable plate 26 by the columns 31*a* and 31*b*, the coil springs 32*a* and 32*b*, and the double nuts 33*a* and 33*b*. The square pillar 28 constituting the upper frame 27 has a vertical, columnar threaded through hole 34. A columnar upper block 35 having a threaded outer circumferential surface is screwed into the columnar through hole 34 of the square pillar 28. A second perforating member 36 having the shape of, e.g., a rectangular equilateral triangle is formed on the lower surface of the upper block 35 so as to oppose the first perforating member 22 on the upper surface of the lower block 21. The rectangular equilateral triangular second perforating member 36 has the same dimensions as the first perforating member 22 on the upper surface of the lower block 21. As illustrated in FIG. 3, the second perforating member 36 is formed by depositing a large number of particles, e.g., synthetic diamond particles 37, having acute corners and a Mohs hardness of 5 or more on the surface of the upper block 35 via an electro-deposition layer 38.

The lower end of a piston 39 is inserted into the upper block 35. A pressure sensor 40 is attached to the lower end of the piston 39. The piston 39 is vertically moved by a second hydraulic mechanism (not shown) constituting the driving means. When the piston 39 is moved down, the upper frame 27 is moved down toward the lower frame 15. The upper frame 27 is so moved that the distance between the second perforating member 36 on the upper block 35 of the upper frame 27 and the first perforating member 22 on the lower block 21 of the lower frame 15 becomes smaller than the thickness of a processed film having a plurality of unsealed pouches (to be described later).

The operation of the tearability imparting apparatus according to the present invention will be described below with reference to FIGS. 1 to 3 explained above and FIGS. 4 to 9.

First, a plurality of folded portions serving as gussets (to be described later) are formed in the longitudinal direction of an elongated laminated film consisting of a nylon film and a polyethylene film. This laminated film is folded in two in the longitudinal direction so that the polyethylene film is located inside. The two side portions along the longitudinal direction of the film are heat-sealed together to prepare an elongated, layflat and tubular member whose leading and trailing ends are open. This tubular member is heat-sealed to manufacture a pre-form 42, FIG. 4, in which a plurality of pairs of axially symmetrical gusset unsealed pouches 41 are successively formed in the longitudinal direction of the film. The pre-form 42 is made from the laminated film of the nylon film and the polyethylene film. Each unsealed pouch 41 has a heat seal 43 formed in the peripheral edges, a gusset 44 formed in the bottom, an elongated discharge portion 45 formed in the upper corner and having a closed end, and a liquid injection portion 46 opened in a portion of the side near the discharge portion 45.

Figure 5:
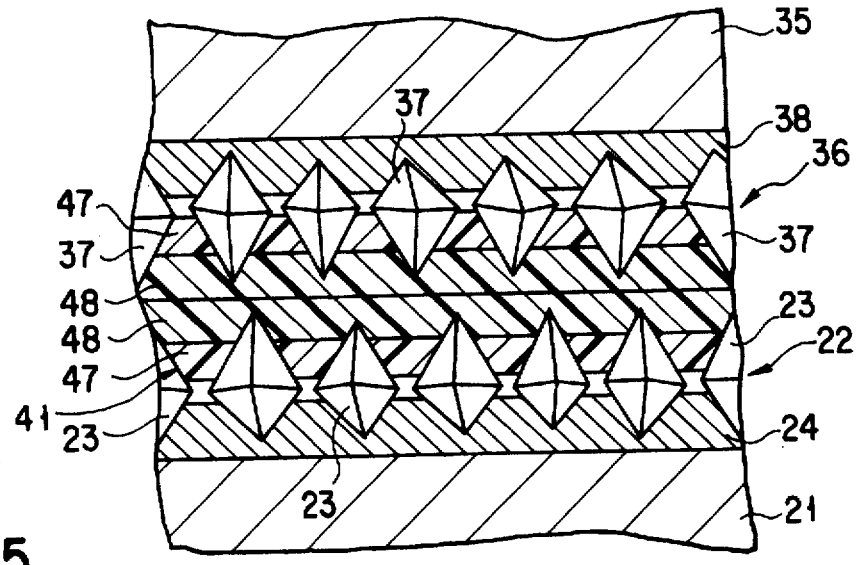
FIG. 5 is a sectional view showing a process of imparting tearability to a corner of the unsealed pouch formed in the pre-form.
Figure 6:
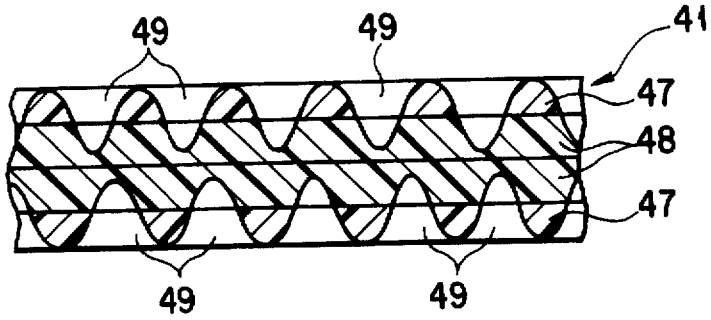
FIG. 6 is a sectional view showing the corner of the unsealed pouch to which tearability is imparted.
Figure 4:
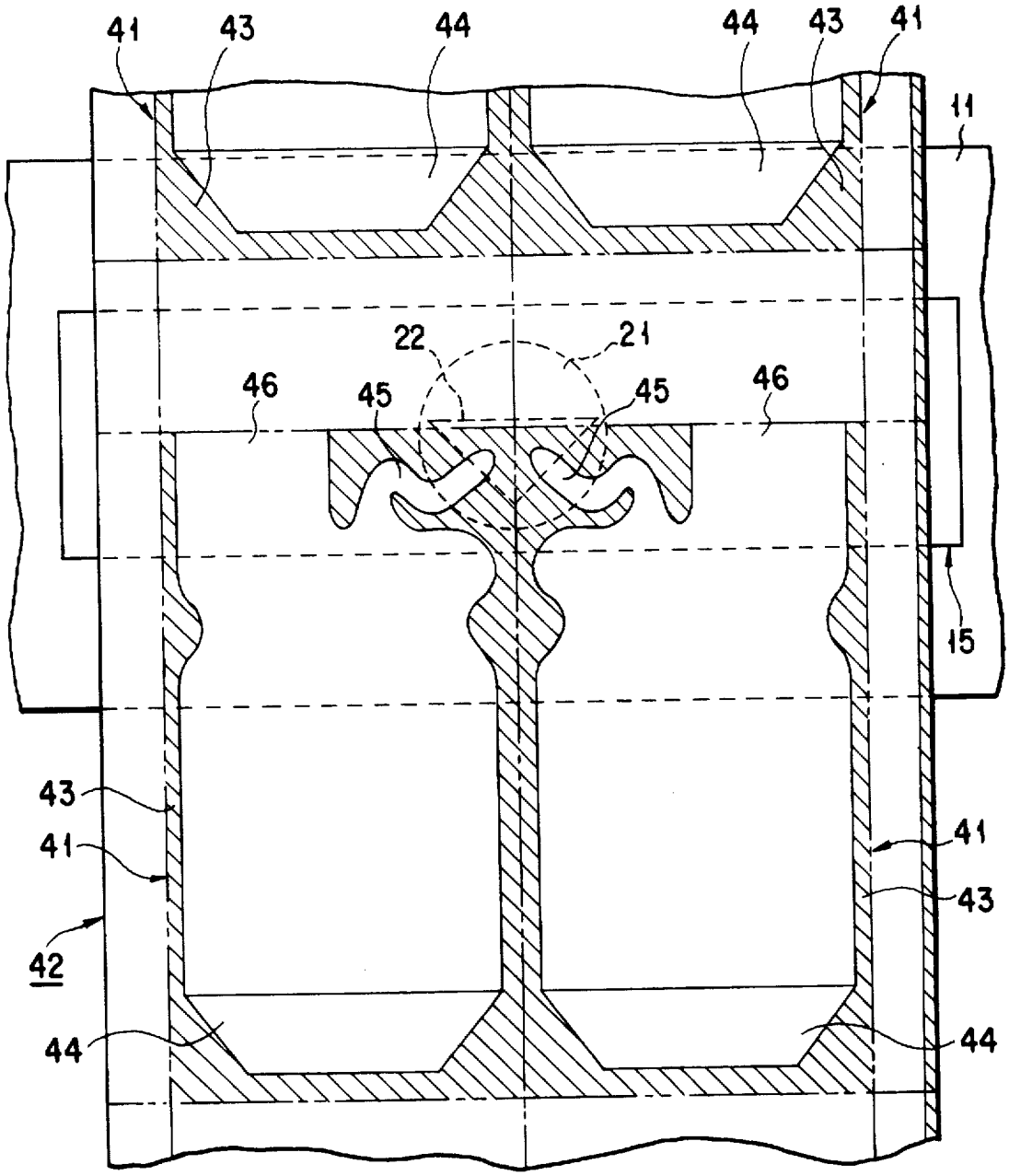
FIG. 4 is a plan view showing a pre-form conveyed onto the table shown in FIG. 1 and having a plurality of unsealed pouches.

As illustrated in FIG. 4, the pre-form 42 is supplied onto the table 11 such that a region including the corners having the elongated liquid discharge portions 45 of the two axially symmetrical gusset unsealed pouches 41 formed in the pre-form 42 is positioned on the rectangular equilateral triangular first perforating member 22 on the upper surface of the lower block 21 of the table 11. In this state the first hydraulic mechanism (not shown) of the driving means is operated to move the movable plate 26 downward, thereby moving the second perforating member 36 formed on the upper block 35 of the upper frame 27 suspended from the movable plate 26 closer to the surface of the pre-form 42. Thereafter, the second hydraulic mechanism (not shown) of the driving means is operated to move the piston 39 downward, moving the upper frame 27 toward the lower frame 15 of the table 11. The upper frame 27 is moved to a position at which the distance between the points of the synthetic diamond particles 23 and 37 constituting the first and second perforating members 22 and 36 of the blocks 21 and 35 of the lower and upper frames 15 and 27 is smaller than the thickness of the pre-form 42 supplied on the table 11. Consequently, as illustrated in FIG. 5, on the first perforating member 22 of the lower block 21 the acute corners of the large number of diamond particles 23 are pressed into the unsealed pouch 41 of the pre-form 42 through an outside nylon film 47 to an almost middle portion of an inside polyethylene film 48. At the same time, on the second perforating member 36 of the upper block 35 the acute corners of the large number of diamond particles 37 are pressed into the unsealed pouch 41 through the outside nylon film 47 to a nearly middle portion of the inside polyethylene film 48. Consequently, as illustrated in FIG. 6, a large number of non-through pores 49 are formed from both the surfaces of the corner of the unsealed pouch 41 made from the laminated film of the polyethylene film 48 and the nylon film 47, at which the closed, long and narrow liquid discharge portion 45 is located.

The pre-form thus processed by the tearability imparting apparatus is cut along a separation line indicated by the long and two short dashed line in FIG. 4. The result is the gusset unsealed pouch 41, FIG. 7, having a triangular non-through pore formation region 50 with a large number of non-through pores in the corner in which the elongated liquid discharge portion 45 is located. A liquid detergent, for example, is injected into the gusset unsealed pouch 41 through the liquid injection portion 46, and the portion 46 is heat-sealed. The result is a gusset sealed pouch 52, FIG. 8, containing a liquid detergent 51 and having the triangular non-through pore formation region 50 in the corner in which the elongated liquid discharge portion 45 is located.

Figure 8:
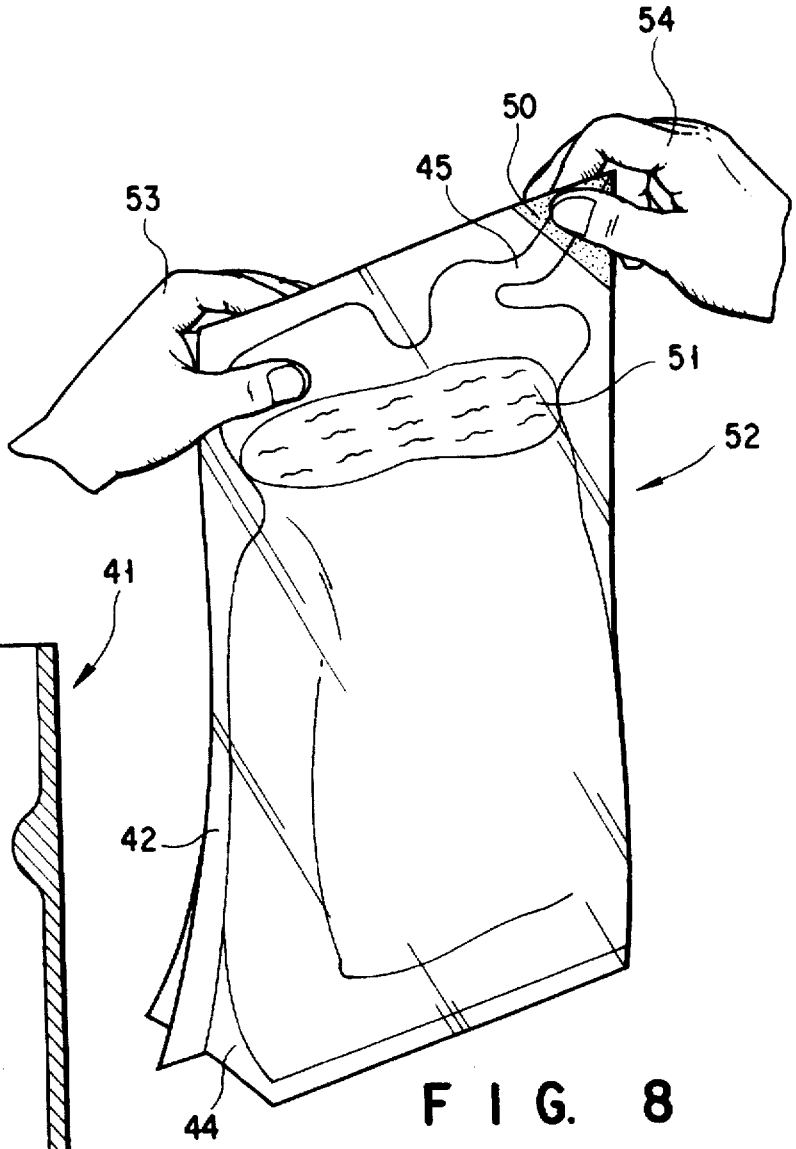
FIG. 8 is a perspective view showing the way a sealed pouch is opened after a liquid is contained in the unsealed pouch obtained by the embodiment.
Figure 7:
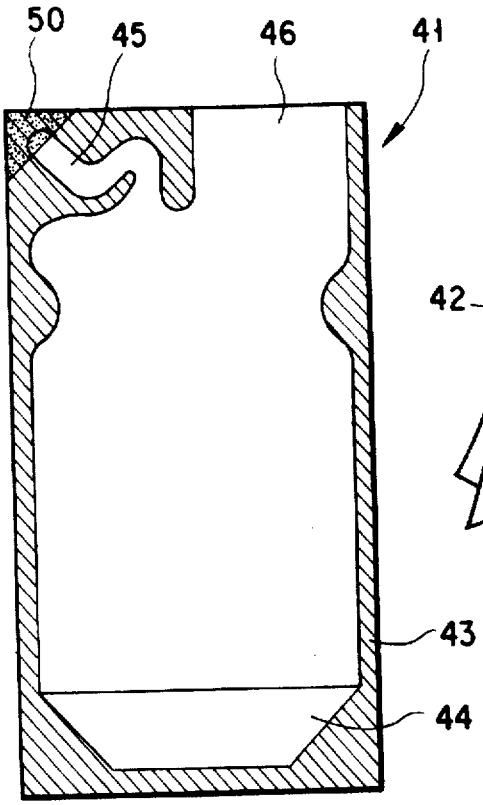
FIG. 7 is a plan view showing the tearable unsealed pouch obtained by the embodiment of the present invention.
Figure 9:
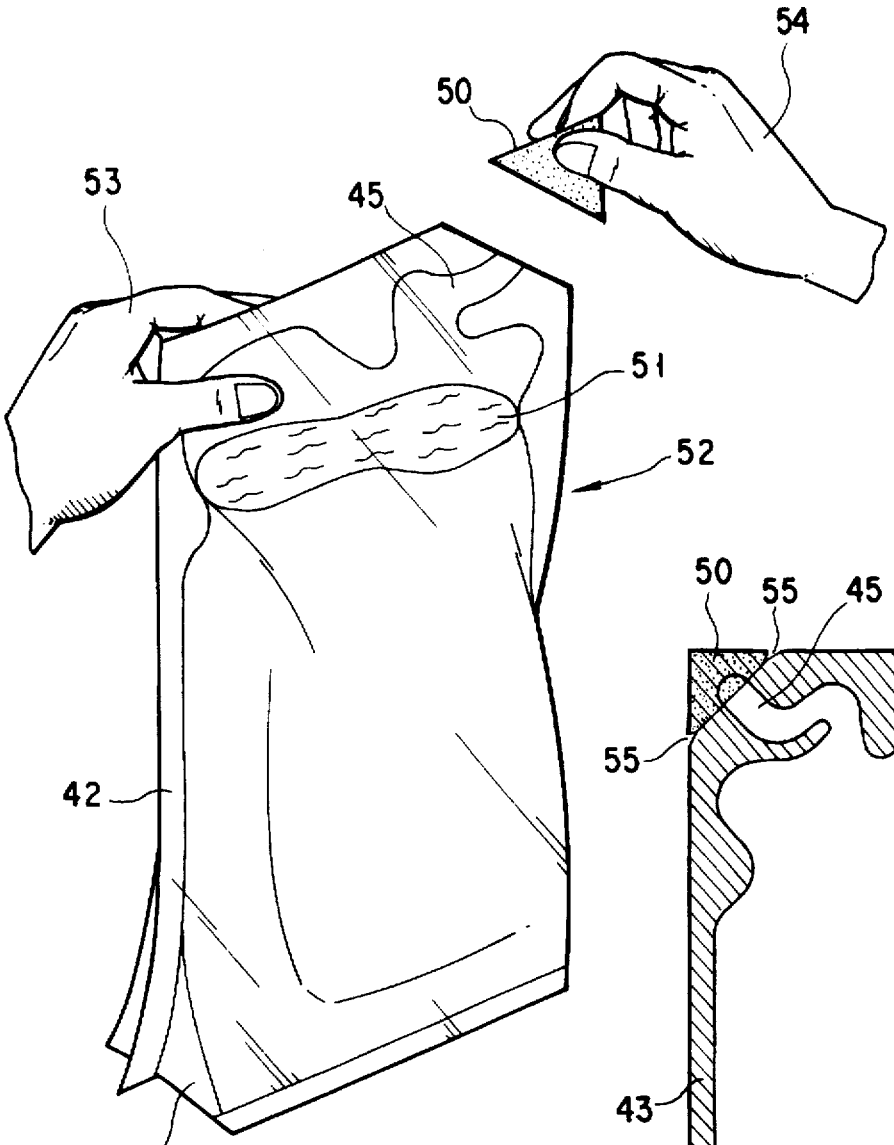
FIG. 9 is a perspective view showing the state in which the sealed pouch in FIG. 8 is opened.

As in FIG. 8, this sealed pouch 52 with the above structure is held by fingers of one hand 53 and the non-through pore formation region 50 is pulled by fingers of the other hand 54. As a consequence, the large number of non-through pores 49 successively act as the starting points of tear on the two sides of the boundary between the non-through pore formation region 50 and a region where no non-through pores are formed. Accordingly, as illustrated in FIG. 9, the corner (triangular non-through pore formation region 50) of the sealed pouch 52 at which the liquid discharge portion 45 is located is readily torn apart in the boundary and separated. Therefore, in opening the sealed pouch 52 to discharge the liquid detergent 51 contained in the pouch through the closed liquid discharge portion 45, the liquid discharge portion 45 can be opened by easily tearing apart the non-through pore formation region 50 in the corner of the pouch by hands without using scissors unlike in the case of conventional sealed pouches. This greatly simplifies the act of opening.

Also, when the second hydraulic mechanism (not shown) of the driving means is operated to move the piston 39 downward to urge the upper frame 27 against the lower frame 15 of the table 11, an excess pressing force acting between the lower and upper frames 15 and 27 can be reduced by the springs **19*a* and 19*b* interposed between the bottom surface of the depression 12 and the lower surface of the plate 17 of the lower frame 15. As a result, when the first and second perforating members 22 and 36 formed on the blocks 21 and 35 of the lower and upper frames 15 and 27 are pressed with the unsealed pouches 41 sandwiched between them, it is possible to prevent the electro-deposition layers 24 and 38 in the perforating members 22 and 36 from cracking or breaking. This can avoid removal, resulting from, e.g., formation of cracks, of the large number of synthetic diamond particles 23 and 37 deposited by the electro-deposition layers 24 and 38**.

Furthermore, the lower block 21 having the first perforating member 22 is screwed into the columnar through hole 20 formed in the square pillar 16 of the lower frame 15, and the upper block 35 having the second perforating member 36 is screwed into the columnar through hole 34 formed in the square pillar 28 of the upper frame 27. That is, these blocks 21 and 35 are removably attached to the square pillars 16 and 28, respectively. Accordingly, the shape or dimensions of the perforating members 22 and 36 can be changed simply by replacing the respective blocks.

In the above embodiment the shape of the perforating members is a rectangular equilateral triangle, but the present invention is not limited to the embodiment. For example, band-like perforating members also can be formed.

Before supplying the pre-form 42 to the table 11 as shown in FIG. 4, the polyethylene films may be sealed together at the non-through pore formation region 50 of each unsealed pouch. More specifically, the polyethylene films of the liquid discharge portion located at the boundary between the non-through pore formation region and a region in which no non-through pores are formed, in the case of gusset sealed pouch which has been separated from the pre-form, which as the non-through pore formation region and which contained liquid detergent. When a user pulls the non-through pore formation region with one hand, while holding the gusset sealed pouch in the other hand, the pouch is easily torn, without elongating the polyethylene films. This is because the polyethylene films, i.e., the inner layers of the gusset sealed pouch, are sealed together at the boundary between the non-through pore formation region and the region in which no non-through pores are formed. Hence, the non-through pore formation region can be peeled more easily than in the case of the gusset sealed pouch illustrated in FIG. 8, thereby to open the liquid discharge portion.

Figure 10:
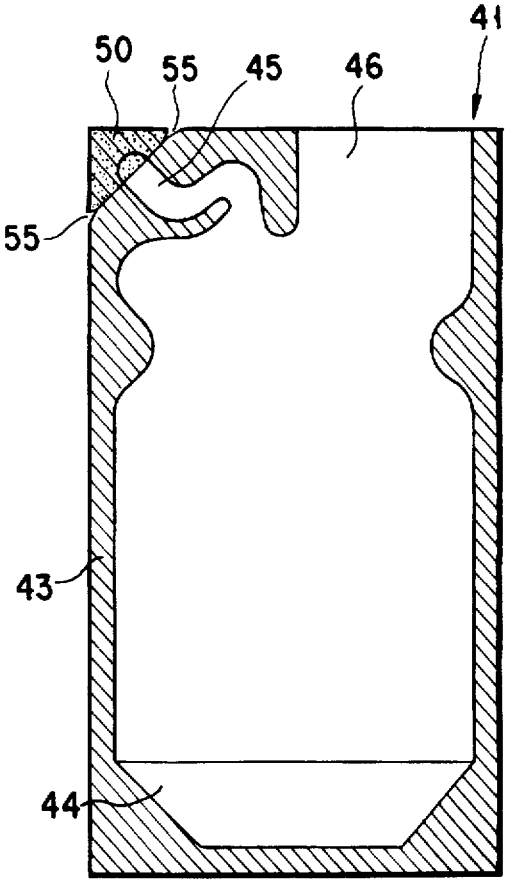
FIG. 10 is a plan view showing a modification of the unsealed pouch to which tearability is imparted by the tearability imparting apparatus of the present invention.

Prior to separating the unsealed pouches by cutting the pre-form processed by the tearability imparting apparatus of the present invention, it is possible to form V cuts in the sides of the corner at the two ends of the boundary between the non-through pore formation region and the region where no non-through pores are formed, thereby manufacturing gusset unsealed pouch 41 having V cuts 55 as shown in FIG. 10. These V cuts 55 can also be formed in the unsealed pouches after they are separated by cutting the preform. A desired liquid is injected through the liquid injection portion 46 of the unsealed pouch 41, and the injection portion is heat-sealed to obtain a sealed pouch. When this sealed pouch is held by fingers of one hand and the non-through pore formation region is pulled by fingers of the other hand as described previously, one of the V cut portions acts as the first starting point of tear. Accordingly, the corner (triangular non-through pore formation region) at which the liquid discharge portion is located can be extremely easily torn apart along the boundary and separated.

Figure 11:
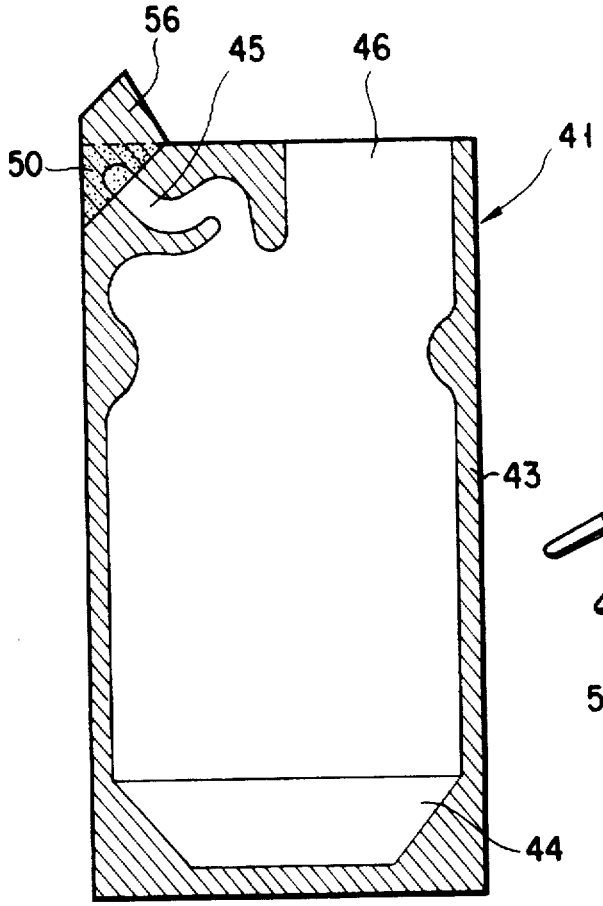
FIG. 11 is a plan view showing another modification of the unsealed pouch to which tearability is imparted by the tearability imparting apparatus of the present invention.
Figure 12:
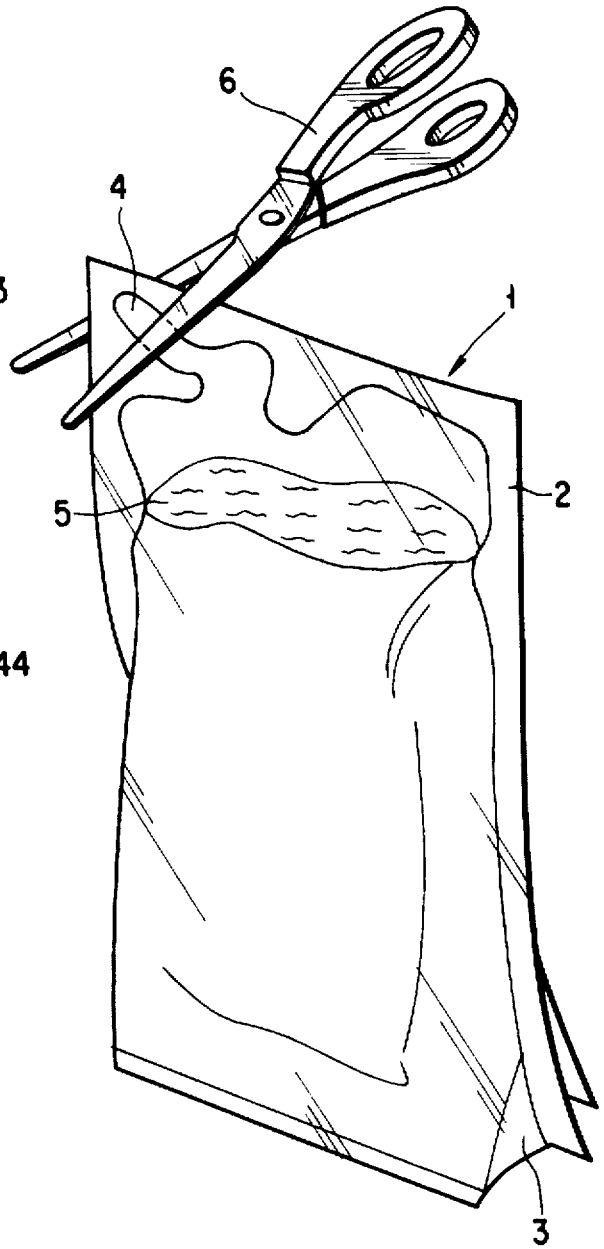
FIG. 12 is a perspective view showing a conventional sealed pouch containing a liquid.

In separating the unsealed pouches by cutting the pre-form processed by the tearability imparting apparatus of the present invention, it is also possible to manufacture the gusset unsealed pouch 41 by forming a projecting piece 56 connecting with the non-through pore formation region 50 as illustrated in FIG. 11. A sealed pouch is obtained by injecting a desired liquid through the liquid injection portion 46 of the unsealed pouch 41 and heat-sealing the injection portion 46. In tearing apart and separating the corner at which the closed liquid discharge portion is located, while the sealed pouch is held by fingers of one hand the non-through pore formation region with a large area including the projecting piece can be pulled by fingers of the other hand. Consequently, the non-through pore formation region can be pulled with a stronger force, and this further facilitates the act of tearing and separating.

Although tearability is imparted to gusset unsealed pouches in the above embodiment, the present invention is similarly applicable to common unsealed pouches with no gusset.

As has been described above, the tearability imparting apparatus according to the present invention can impart tearability to the corner of an unsealed pouch at which a closed liquid discharge portion is located, thereby making the corner easily tearable obliquely. Accordingly, by injecting a desired liquid into the unsealed pouch and sealing the pouch it is possible to obtain a sealed pouch capable of being opened by easily tearing apart the corner at which the liquid discharge portion is located by hands without using scissors unlike in the case of conventional sealed pouches.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A tearability imparting apparatus for imparting to a pre-form which has been prepared by heat-sealing a layflat and tubular member opening both ends and having a heat-fusible film on inner surface, and which has a plurality of unsealed pouches, each having a opening in one side, more precisely, imparting tearability to the corner of each unsealed pouch, in which the closed liquid discharge portion is located, said apparatus comprising:

a lower block having a flat surface and a first perforating member which is provided on the flat surface, which corresponds to the corner of each unsealed pouch and which has been formed by depositing on the flat surface a large number of particles having acute corners and a Mohs hardness of not less than 5;

an upper block arranged above said lower block and having a flat surface and a second perforating member which is provided on the flat surface opposing said first perforating member and which has been formed by depositing on the flat surface a large number of particles having acute corners and a Mohs hardness of not less than 5 on said surface region; and driving means for moving said upper block toward said lower block until a distance between points of said particles on said first and second perforating members becomes smaller than a thickness of the pre-form supplied onto said lower block, thereby pressing the acute corners of said large number of particles into both surfaces of the corner of each unsealed pouch formed in the pre-form, forming non-through pore formation regions in the corner of each unsealed pouch, which have a large number of non-through pores on the both sides.

2. An apparatus according to claim 1, wherein the tubular member is made solely from a heat-fusible resin film.

3. An apparatus according to claim 2, wherein the heat-fusible resin is polyethylene.

4. An apparatus according to claim 1, wherein the tubular member is made from a laminated film consisting of a heat-fusible resin film and a rigid organic resin film and in which the heat-fusible resin film is arranged on inner surfaces.

5. An apparatus according to claim 4, wherein the heat-fusible resin film is a polyethylene film and the rigid organic resin film is a polyethyleneterephthalate film.

6. An apparatus according to claim 1, wherein the unsealed pouches formed in the pre-form are gusset-type pouches each having a closed liquid discharge portion in an upper portion, an open liquid injection portion adjacent to the liquid discharge portion, and a gusset in a bottom.

7. An apparatus according to claim 1, wherein said large number of particles having acute corners and a Mohs hardness of not less than 5 are synthetic diamond particles, said upper and lower blocks consist of a metal, and said synthetic diamonds are electro-deposited on said upper and lower blocks, respectively.

8. An apparatus according to claim 1, wherein a plurality of said first perforating members and a plurality of said second perforating members are formed on the surfaces of said lower and upper blocks, respectively, so as to oppose each other.

9. An apparatus according to claim 7, wherein said diamond particles have a mean particle size of 10 to 100 μm.

10. An apparatus according to claim 1, wherein each of said first and second perforating members has the shape of an isosceles triangle.

11. A tearability imparting apparatus for imparting to a tearable region to a preform with an inner surface, an upper surface, a lower surface, and sides, a heat fusible film disposed on said inner surface, the preform comprising a plurality of pouches, one side of each pouch defining an opening, comprising:

a lower block having a first flat surface and a first perforating member which is provided on the first flat surface, which corresponds to the corner of each unsealed pouch and which has been formed by depositing on the first flat surface a large number of particles having acute corners and a Mohs hardness of not less than 5 on said first surface region;

an upper block arranged above said lower block and having a second flat surface and a second perforating member which is provided on the second flat surface opposing said first perforating member and which has been formed by depositing a large number of particles having acute corners and a Mohs hardness of not less than 5 on said second surface region; and means for moving said upper block toward said lower block until a distance between points of said particles on said first and second perforating members becomes smaller than a thickness of the preform disposed between said upper block and said lower block, thereby pressing the acute corners of said large number of particles into opposing regions on the upper surface and the lower surface of the preform over the opening defined by a side of a pouch, thereby sealing the opening with a tearable area.

* * * * *